US006527363B1

(12) United States Patent
Bowling et al.

(10) Patent No.: US 6,527,363 B1
(45) Date of Patent: Mar. 4, 2003

(54) LOW PROFILE DISPOSABLE POLYMER WICKING PAD

(75) Inventors: Bruce A. Bowling, Beavercreek, OH (US); David A. Huliba, Centerville, OH (US)

(73) Assignee: Scitex Digital Printing, Inc., Dayton, OH (US)

( * ) Notice: Subject to any disclaimer, the term of this patent is extended or adjusted under 35 U.S.C. 154(b) by 0 days.

(21) Appl. No.: 09/916,992

(22) Filed: Jul. 27, 2001

(51) Int. Cl.[7] ..... B41J 2/165; B41J 2/185
(52) U.S. Cl. ..... 347/36; 347/90
(58) Field of Search ..... 347/36, 90, 73

(56) References Cited

U.S. PATENT DOCUMENTS 4,268,836 A * 5/1981 Huliba et al. ..... 347/74
4,554,193 A * 11/1985 Erickson ..... 428/40
5,827,589 A * 10/1998 Autterson ..... 428/40.1
6,331,335 B1 * 12/2001 Autterson ..... 428/40.1

FOREIGN PATENT DOCUMENTS

EP 0 741 040 A2 * 11/1996 ..... B41J/2/185
WO WO 93/08026 * 4/1993 ..... B41J/2/20

* cited by examiner

*Primary Examiner*—Judy Nguyen
(74) *Attorney, Agent, or Firm*—Barbara Joan Haushalter

(57) ABSTRACT

A laminated structure utilizes differential adhesive to achieve high adhesion to a wicking material and low adhesion where removal is desired. The low profile wicking pad is useful in any technology where it is desirable to control excess moisture with a passive device. The wicking device is particularly useful in the field of continuous ink jet printing systems, where the low profile of the device is desirable and the cost reduction makes disposability of the device a reality. In ink jet printing systems, the wicking device improves ink jet printhead performance via ink mist and ink drip elimination.

20 Claims, 2 Drawing Sheets

LOW PROFILE DISPOSABLE POLYMER WICKING PAD

TECHNICAL FIELD

The present invention relates to continuous ink jet printing systems and, more particularly, to a low profile and disposable hydrophillic polymer device that collects ink splatter and condensation on the bottom of an ink jet printhead.

BACKGROUND ART

In general, continuous ink jet printing apparatus have a printhead manifold to which ink is supplied under pressure so as to issue in streams from a printhead orifice plate that is in liquid communication with the cavity. Periodic perturbations are imposed on the liquid streams, such as vibrations by an electromechanical transducer, to cause the streams to break-up into uniformly sized and shaped droplets.

A charge plate, comprising an array of addressable electrodes, is located proximate the streams break-off points to induce an electrical charge, selectively, on adjacent droplets, in accord with print information signals. Charged droplets are deflected from their nominal trajectory. For example, in a common, binary, printing mode, charged or non-print droplets are deflected into a catcher device and non-charged droplets proceed to the print medium.

While printing, the impact of the print drops on the paper can produce ink mist. Some of this ink mist can accumulate on the bottom of the printhead. Operation of the printhead near the extremes of the operation window can also cause additional ink to accumulate on the bottom of the printhead. The accumulation of ink on the bottom of the printhead can be excessive during high speed operation of the printer, so that eventually the ink will drip off the printhead onto the print medium. Current art uses wicking devices for collecting ink splatter and condensation that collect around the printhead. However, existing wicking devices have some undesirable limitations. For example, most are attached with screws or magnets, which are expensive and add "throw" distance to a relative substrate. Second, most existing wicking devices use thick pads for absorption, which also adds "throw" distance to a relative substrate. Also, currently used pad assemblies have costly construction. With such high cost, end users must clean and re-use the pad assemblies. This can be a messy and time consuming operation.

It is seen then that there is a need for an improved wicking device which overcomes the problems associated with the prior art.

SUMMARY OF THE INVENTION

This need is met by the device according to the present invention, wherein ink splatter and condensation on the bottom of an ink jet printhead are collected. A low profile and disposable hydrophillic polymer device achieves this.

In accordance with one aspect of the present invention, a laminated structure utilizes differential adhesive to achieve high adhesion to a wicking material and low adhesion where removal is desired.

Accordingly, it is an object of the present invention to provide a light weight, low profile wicking pad for continuous ink jet printing systems. It is a further object of the present invention to provide such a device which is disposable. It is yet another object of the present invention to improve ink jet printhead performance via ink mist and ink drip elimination, while maintaining a reduced throw distance from the drop generator to the paper.

Other objects and advantages of the invention will be apparent from the following description, the accompanying drawings and the appended claims.

DETAILED DESCRIPTION OF THE PREFERRED EMBODIMENTS

The present invention proposes an improved wicking pad for accumulation of excess moisture from a surface of any type of moisture sensitive apparatus. Although the present invention is applicable for use with any moisture sensitive apparatus, for purposes of example only, it is shown herein as being used in the printing industry.

Figure 1:
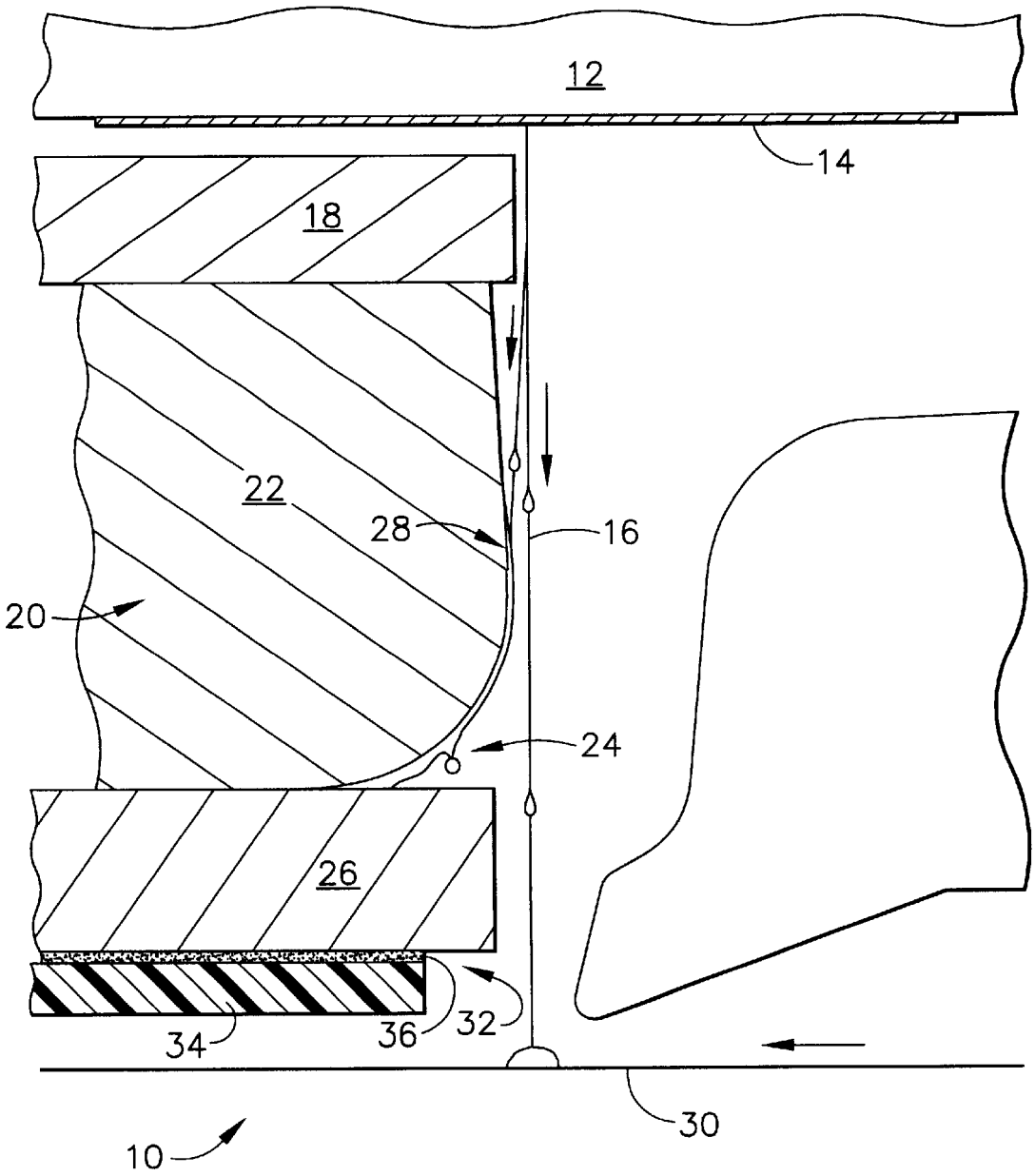
FIG. 1 illustrates an ink jet head printhead structure, showing the location of the low profile polymer device of the present invention.

Referring to the drawings, a view of an ink jet printhead of the type that may employ the present invention to collect moisture such as ink splatter and condensation from moisture sensitive surfaces of the printhead is shown in FIG. 1. The printhead assembly, generally designated 10, includes a resonator 12 having an orifice plate 14 for generating filaments of ink 16. The resonator stimulates the filaments to break off into droplets in the region of a charge plate 18 associated with a catcher assembly, generally designated 20. The catcher assembly 20 comprises a catcher 22, a catcher throat 24, and a catcher plate 26. Drops of ink are selectively charged by charging electrodes and deflected onto catcher face 28 and into catcher throat 24. Uncharged drops proceed undeflected to a print medium 30. Collected ink is withdrawn and recirculated.

Continuing with FIG. 1, there is illustrated the wicking device 32 of the present invention. The wicking device comprises a porous polymer 34 for collecting ink mist, ink splatter and condensation from a surface of the printhead, with the exemplary surface shown here being a catcher plate. The wicking device 32 also comprises a differential adhesive layer 36, between the surface (i.e., the catcher plate) and the porous polymer 34.

Figure 2:
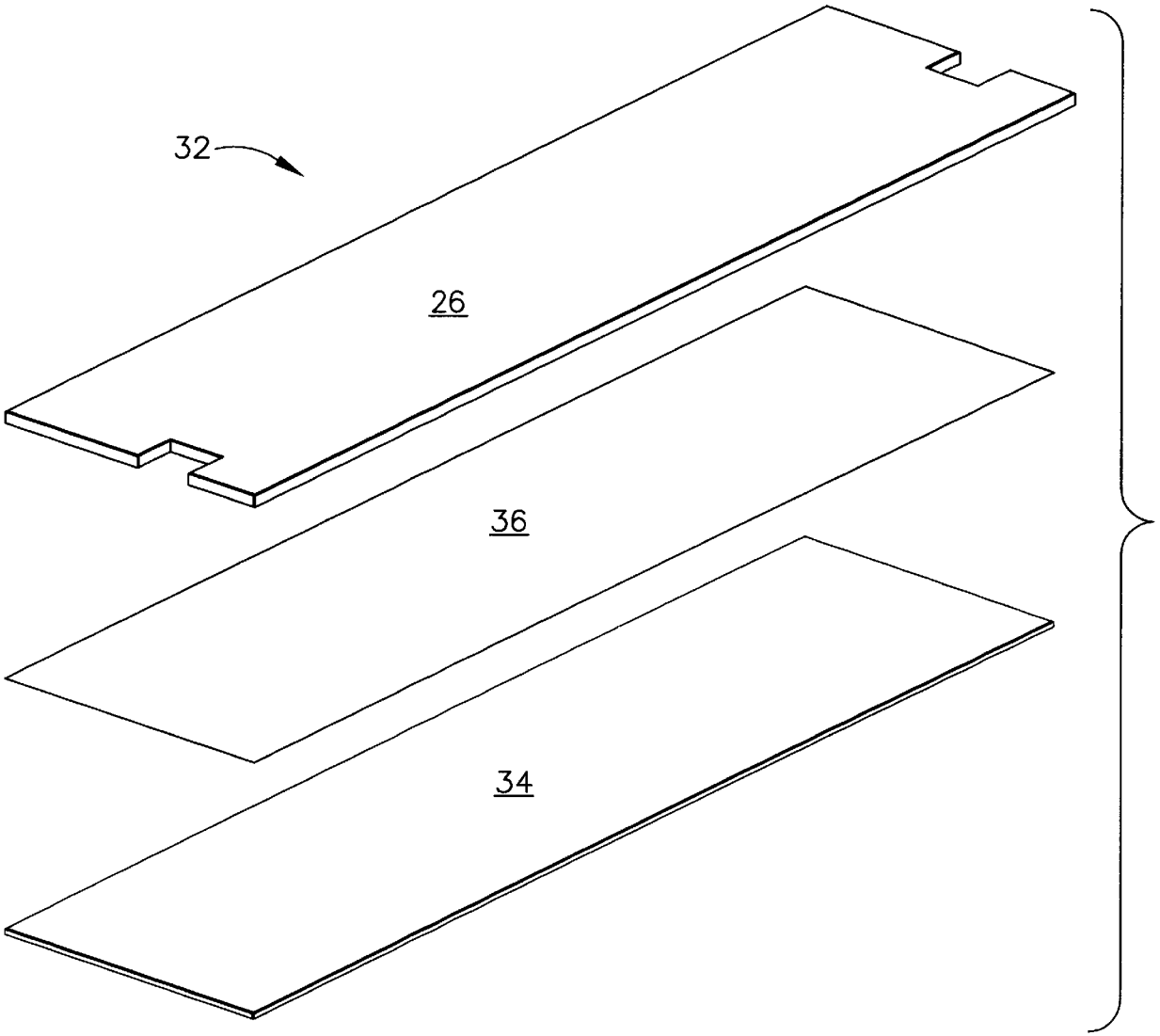
FIG. 2 is an exploded view showing the layers comprising the low profile polymer device of the present invention.

As best illustrated in FIG. 2, the differential adhesive layer 36 has a first or top side for contacting the moisture sensitive surface, such as catcher plate 26, and a second or bottom side for contacting the porous polymer 34. In a preferred embodiment, the side of the adhesive layer contacting the moisture sensitive surface will have lower adhesion properties than the side of the adhesive layer contacting the porous polymer 34.

The purpose of the present invention is to provide a device 32 for collecting ink splatter and condensation from a moisture sensitive surface, such as the bottom of the ink jet printhead 10. The device 32 is a low profile wicking device, which offers the advantage in the ink jet printing industry of decreasing the throw distance of the drops which can significantly improve print quality. The light weight of the device 32 also allows the wicking pad to be attached to moveable components of the printhead, such as the eyelid, without affecting the actuator.

Continuing with FIG. 2, the device 32 comprises a laminated structure that utilizes differential adhesive to achieve high adhesion to a wicking material and low adhesion to the catcher or other printhead component such as an eyelid, where removal is desired. In a preferred embodiment of the present invention, a 4-to-1 or greater differential is desirable. If the removal adhesion from the printhead component is greater than 5 oz/in, removal of the wicking pad from the catcher plate or other printhead component can damage the catcher plate bond or otherwise damage the printhead component. The differential adhesive must have a adhesion of greater than 20 oz/in on the side attached to the porous polymer layer. Lower levels of adhesion to the porous polymer material can lead to delamination of this bond.

In accordance with the present invention, the differential adhesive layer 36 is applied to the moisture sensitive surface, such as the catcher plate 26, on a mounting side of the moisture sensitive surface. Although differential adhesives are commercially available, prior use of such materials in ink jet is unknown. The side of the adhesive layer that contacts the catcher plate has low adhesion properties, to promote removal of the ink splatter and condensation.

The side of the adhesion layer opposite the catcher plate contacts the porous polymer layer 34. The porous polymer is preferably a hydrophilic, high density, polyethylene filter material, as a hydrophilic material promotes wicking. The high density, polyethylene filter is compatible with our inks. Unlike cellulose based materials, this material does not swell when it gets wet. Materials that swell would require increased clearance between the print medium and the printhead to allow for the swelling. The filter material is an open cell structure with a high void fraction for collecting the ink. Suitable porous polymers are commercially available. The wicking nature of the material disperses the ink throughout the porous material. This increases the surface area of the ink so that moisture can be evaporating from some portions of the wicking pad while additional moisture is accumulating in other areas. As a result, the effective holding capacity for ink mist can be quite large.

When the pad is full, the low adhesion to the catcher plate, or other printhead components, provided by the differential adhesive, allows the wicking pad to be easily removed. The preferred polyethylene filter material provides sufficient strength to the wicking pad so that it does not tear when it is peeled from the catcher plate or other printhead components. The low cost of this wicking pad eliminates the financial and burdensome requirement of reusing the pad. The spent pad can therefore be disposed of and a new wicking pad easily installed.

Utilizing a differential adhesion approach allows the effective print distance to be closer to the substrate, which is very desirable for the printing process. Since the differential adhesive is no thicker than 0.005", with 0.003" being a preferred thickness, the polymer device can achieve the desired low profile arrangement. Some existing wicking devices utilize a magnet, increasing the distance to the substrate by 0.06". Alternatively, some existing wicking devices use a fastener, which involves use of tools, and requires consideration of clearances for the head of the screw or other fastener. These techniques add greatly to the throw distance of the printhead.

A thin absorption pad or porous polymer 34 is highly desirable so that minimum throw distance is achieved. The prior art uses a pad thickness of 0.06". In a preferred embodiment, the present invention makes use of a hydrophillic, high density polyethylene polymer filter material with a pore size of 30–150 micron, 80 microns being preferred, and a thickness of only about 0.005 to 0.050", with a thickness of 0.024" being preferred.

By eliminating hardware and use of a laminated die cut assembly, great cost reduction is achieved with the present invention. The cost reduction is great enough that the device according to the present invention is disposable. Prior art devices required so much hardware and labor to assemble, it could not be cost effective to dispose of the wicking material after use.

The device of the present invention eliminates ink and condensation pooling so that drips do not form and fall onto the printing material. The device also helps to absorb the ink mist/splatter generated when ink drops hit the substrate.

The invention has been described in detail with particular reference to certain preferred embodiments thereof, but it will be understood that modifications and variations can be effected within the spirit and scope of the invention.

What is claimed is:

1. In an ink jet printer, an improved wicking device associated with a printhead of the printer, the improved wicking device comprising:

a porous polymer for collecting ink mist, ink splatter and condensation from at least one surface of the printhead adjacent to the print medium; and a differential adhesive layer between the at least one surface and the porous polymer, the differential adhesive layer having a first side for contacting the at least one surface of the printhead and a second side for contacting the porous polymer, wherein the first side has lower adhesion properties than the second side.

2. An improved wicking device as claimed in claim 1 wherein the differential adhesive layer comprises a differential adhesive having at least a 4-to-1 differential.

3. An improved wicking device as claimed in claim 1 wherein the differential adhesive layer comprises a differential adhesive having less than 5 oz/in to the surface of the printhead.

4. An improved wicking device as claimed in claim 1 wherein the differential adhesive layer comprises a differential adhesive having an adhesion of greater than 20 oz/in to the porous polymer.

5. An improved wicking device as claimed in claim 1 wherein the porous polymer comprises a hydrophillic material.

6. An improved wicking device as claimed in claim 1 wherein the porous polymer comprises a polyethylene material.

7. An improved wicking device as claimed in claim 6 wherein the polyethylene material comprises a high density polyethylene material.

8. An improved wicking device as claimed in claim 7 wherein the polyethylene material comprises a filter material having an open cell structure with a high void fraction for collecting ink.

9. An improved wicking device as claimed in claim 1 wherein the porous polymer comprises a polymer having a pore size of about 30 to 150 micron.

10. An improved wicking device as claimed in claim 1 wherein the porous polymer comprises a polymer having a thickness of approximately 0.005 to 0.050 inches.

11. An improved wicking device as claimed in claim 1 wherein the at least one surface of the printhead comprises a catcher plate surface.

12. An improved wicking pad for accumulation of excess moisture from a surface of a moisture sensitive apparatus, the improvement comprising:

a porous polymer for accumulation of excess moisture from at least one surface of the apparatus; and a differential adhesive layer between the at least one surface and the porous polymer, the differential adhesive layer having a first side for contacting the surface and a second side for contacting the porous polymer, wherein the first side has lower adhesion properties than the second side.

13. An improved wicking device as claimed in claim 12 wherein the differential adhesive layer comprises a differential adhesive having at least a 4-to-1 differential.

14. An improved wicking device as claimed in claim 12 wherein the differential adhesive layer comprises a differential adhesive having less than 5 oz/in to the surface of the printhead.

15. An improved wicking device as claimed in claim 12 wherein the differential adhesive layer comprises a differential adhesive having an adhesion of greater than 20 oz/in to the porous polymer.

16. An improved wicking device as claimed in claim 12 wherein the porous polymer comprises a hydrophillic material.

17. An improved wicking device as claimed in claim 12 wherein the porous polymer comprises a polyethylene material.

18. An improved wicking device as claimed in claim 17 wherein the polyethylene material comprises a high density polyethylene material.

19. An improved wicking device as claimed in claim 11 wherein the porous polymer comprises a polymer having a pore size of about 30 to 150 micron.

20. An improved wicking device as claimed in claim 11 wherein the porous polymer comprises a polymer having a thickness of approximately 0.005 to 0.050 inches.

* * * * *